US010006740B1

(12) United States Patent
Keller

(10) Patent No.: US 10,006,740 B1
(45) Date of Patent: Jun. 26, 2018

(54) SIGHT ASSEMBLY FOR FIREARMS

(71) Applicant: Robert Keller, Valrico, FL (US)

(72) Inventor: Robert Keller, Valrico, FL (US)

( * ) Notice: Subject to any disclaimer, the term of this patent is extended or adjusted under 35 U.S.C. 154(b) by 0 days. days.

(21) Appl. No.: 15/402,762

(22) Filed: Jan. 10, 2017

(51) Int. Cl.
*F41G 1/01* (2006.01)
*F41G 1/02* (2006.01)
*F41G 1/10* (2006.01)

(52) U.S. Cl.
CPC ..... *F41G 1/01* (2013.01); *F41G 1/02* (2013.01); *F41G 1/10* (2013.01)

(58) Field of Classification Search
CPC ..... F41G 1/00; F41G 1/01; F41G 1/02; F41G 1/04; F41G 1/06; F41G 1/065; F41G 1/10; F41G 1/12; F41G 1/17
USPC ..... 42/111, 132–142, 144–148
See application file for complete search history.

(56) References Cited

U.S. PATENT DOCUMENTS 2,610,405 A * 9/1952 Dickinson ..... F41G 1/02 42/143
2,815,574 A 12/1957 Du Varry
2,842,848 A * 7/1958 Freidrichsmeier ..... F41G 1/02 42/144
3,698,091 A * 10/1972 Merrill ..... F41G 1/01 42/144
3,834,035 A * 9/1974 Merrill ..... F41G 1/08 42/133
4,606,131 A * 8/1986 Domian ..... F41G 1/16 42/137
4,628,611 A * 12/1986 Ruffino ..... F41G 1/16 42/137
4,713,889 A 12/1987 Santiago
5,065,538 A 11/1991 Allen
6,035,539 A * 3/2000 Hollenbach ..... F41G 1/32 42/132
6,058,615 A * 5/2000 Uhlmann ..... F41G 1/01 42/132
6,058,616 A * 5/2000 Bubits ..... F41G 1/01 42/144
D435,283 S * 12/2000 Ling, Jr. ..... D22/108
6,216,351 B1 * 4/2001 Flubacher ..... F41G 1/34 42/145
D447,206 S * 8/2001 Ling, Jr. ..... D22/108
6,711,846 B1 3/2004 Nasef
6,804,908 B1 * 10/2004 Hanson ..... F41G 1/52 42/111
7,451,566 B1 * 11/2008 Price ..... F41G 1/01 42/111
7,627,976 B1 12/2009 Olson
(Continued)

FOREIGN PATENT DOCUMENTS

EP 2577213 B1 10/2015

*Primary Examiner* — Bret Hayes
(74) *Attorney, Agent, or Firm* — Albert Bordas, P.A.

(57) ABSTRACT

A sight assembly for firearms, having a rear bottom sight, and a rear top sight with first and second top faces. Extending from the first and second top faces are first and second rear sight strips respectively. The sight assembly for firearms further has a front bottom sight, and a front top sight with a third top face. Extending from the third top face is a front sight strip. The sight assembly for firearms produces a continuous sight strip when viewing the front sight strip through a notch defined by the rear top sight mounted onto the rear bottom sight when the front sight strip is aligned with first and second rear sight strips.

18 Claims, 9 Drawing Sheets

(56) References Cited

U.S. PATENT DOCUMENTS

| | | | | |
|---|---|---|---|---|
| 7,934,334 | B2 | 5/2011 | Kraft | |
| 8,635,801 | B2 | 1/2014 | Glimpse et al. | |
| 8,739,454 | B2 | 6/2014 | Erdle et al. | |
| 8,863,433 | B2 | 10/2014 | Kruse | |
| 2010/0088944 | A1 | 4/2010 | Callihan | |
| 2011/0314721 | A1* | 12/2011 | Lamb | F41G 1/345 42/145 |
| 2012/0198750 | A1 | 8/2012 | Mansfield | |
| 2013/0180156 | A1* | 7/2013 | Shebaro | F41G 1/12 42/144 |
| 2015/0109602 | A1 | 4/2015 | Martin et al. | |

* cited by examiner

SIGHT ASSEMBLY FOR FIREARMS

BACKGROUND OF THE INVENTION

1. Field of the Invention

The present invention relates to firearm sights, and more particularly, to rear and front sight assemblies for firearms.

2. Description of the Related Art

Applicant believes that one of the closest references corresponds to U.S. Patent Application Publication No. 20150109602 A1, published on Apr. 23, 2015 to Richard James Martin, et al. for photoluminescent illuminators for passive illumination of sights and other devices. However, it differs from the present invention because Martin, et al. teaches a photoluminescent capsule illuminator for a sighting device that includes an elongated phosphor housing having sidewalls and a base. The photoluminescent illuminator includes phosphors in a granular form disposed inside the phosphor housing. The photoluminescent illuminator includes a cap sealing the phosphors in the phosphor housing. The phosphor housing is disposed in relation to a body of the sighting device such that photoluminescent light emitted from the phosphors exits the phosphor housing and identifies a location of a sight on the sighting device.

Applicant believes that another reference corresponds to U.S. Patent Application Publication No. 20120198750 A1, published on Aug. 9, 2012 to Michael Mansfield for a sight apparatus and related methods. However, it differs from the present invention because Mansfield teaches an aiming apparatus and associated methods for aiming a device such as a firearm. The aiming apparatus includes a front sight configured as a post and a rear sight configured to include a notch. An image portion is formed on the front sight and a complementary image portion formed on the rear sight such that the image portion and the complementary image portion present a unitary image to a viewer of the front sight through the notch when the front sight is aligned with the rear sight.

Applicant believes that another reference corresponds to U.S. Patent Application Publication No. 20100088944 A1, published on Apr. 15, 2010 to Rick Callihan for an illuminated sight for use with firearms and other instruments. However, it differs from the present invention because Callihan teaches a front sight assembly that includes a self-powered, substantially permanent light source, such as a tritium source, that is carried within a bore defined in a housing. The housing defines a structure symmetrically aligned along a central plane, where the bore carrying the light source has a central axis that lies within or parallel to the housing's central plane. The sight assembly housing terminates proximally in a proximal surface that faces a user when mounted on a firearm or other instrument. The sight assembly housing's proximal surface further includes a region surrounding or defining a periphery around the light source which is coated with, laminated with or altered to define a region of photo-luminescence that is substantially concentric with the center of the visible portion of light source.

Applicant believes that another reference corresponds to U.S. Pat. No. 8,863,433 B2 issued to Russell E. Kruse on Oct. 21, 2014 for gun sight with single point reference. However, it differs from the present invention because Kruse teaches a gun sight system that utilizes vernier acuity to provide a single point of sight for aiming. The sight system includes a front sight comprising a sighting structure extending substantially orthogonally from an end of a slide that includes a V-shaped notch in a distal end. The system additionally includes a rear sight comprising a sighting stud extending substantially orthogonally from a rear of the slide and includes an inverted V-shaped tip.

Applicant believes that another reference corresponds to U.S. Pat. No. 8,739,454 B2 issued to Jesse Erdle, et al. on Jun. 3, 2014 for a gun sight with range finder. However, it differs from the present invention because Erdle, et al. teaches a handgun front sight having an elongated, rectangular body with a light pipe inserted into an open space between a rear opening and forward opening. A base of the front sight is slanted to raise a proximate end relative to a distal end. The rear sight has a body with a circular opening for centering the target. A compass ring fits inside the circular opening. A pair of light pipes in the body of the rear sight are aligned with 90 and 270 degree points of the compass ring to establish an imaginary line across the diameter. The front light pipe is centered along that imaginary line.

Applicant believes that another reference corresponds to U.S. Pat. No. 8,635,801 B2 issued to Bryan R. Glimpse, et al. on Jan. 28, 2014 for a gun sight. However, it differs from the present invention because Glimpse, et al. teaches a sighting system for a firearm that includes a rear-sight assembly having a rear surface opposing a shooter, a pair of rear-aiming points, and a U-shaped opening disposed between the pair of rear-aiming points. The rear surface is formed at an angle relative to a top surface of the firearm such that a bottom portion of the rear surface disposed proximate to the top surface of the firearm is farther away from a shooter than a top portion of the rear surface. The sighting system also includes a front-sight assembly including a housing having a front-aiming point, a brightly colored material surrounding the front-aiming point, and a top coat extending over the brightly colored material and the front-aiming point.

Applicant believes that another reference corresponds to U.S. Pat. No. 7,934,334 B2 issued to Timothy W. Kraft on May 3, 2011 for aiming systems. However, it differs from the present invention because Kraft teaches systems for aiming devices used to aim a firearm. The aiming systems comprise a front sight portion having a cross-section with a truncated triangle shape when viewed by an operator aiming the device. The aiming systems comprises a rear sight portion including a notch having a truncated triangle shape with a base, a left side, a right side, and an opening that is narrower than the base. The front sight portion is alignable relative to the notch for aiming the device.

Applicant believes that another reference corresponds to U.S. Pat. No. 7,627,976 B1 issued to Douglas D. Olson on Dec. 8, 2009 for a fiber optic sight for firearms with nighttime capabilities. However, it differs from the present invention because Olson teaches fiber optic sights for firearms with day and night time capabilities that comprise a sight base, a fiber optic rod mounted in a base having an angle cut at a distal end, which is positioned on an underside of the rod, and an artificial light insert that is positioned in a cavity in the fiber optic rod. The cavity is sealed with a fiber optic rod plug and epoxied using an optically clear epoxy. The sight provides increased light output, co-located day and night sight views with increased illumination during the day, and uses a low power tritium insert for nighttime use. At night the sight achieves a transition from a bright ring during the day to a small central dot at night while maintaining the same color light for both.

Applicant believes that another reference corresponds to U.S. Pat. No. 6,711,846 B1 issued to Richard Nasef on Mar. 30, 2004 for a gun sight system. However, it differs from the present invention because Nasef teaches a gun sight system including a front sight portion and a rear sight portion. The rear sight portion comprises a truncated triangle and the front sight portion comprises a triangle substantially the same size and of the same inclined angle as a truncated portion of the rear sight portion. When the front and rear sight portions are vertically and horizontally aligned, an image of a complete triangle is formed for the user and a target is placed on a top point of the triangle of the front sight portion.

Applicant believes that another reference corresponds to U.S. Pat. No. 5,065,538 A issued to Rhandall A. Allen on Nov. 19, 1991 for nocturnal rifle sight organization. However, it differs from the present invention because Allen teaches an apparatus including a front sight aligned with a rear sight mounted coaxial relative to one another overlying a barrel portion of an associated rifle. The front sight is of a generally Y-shaped configuration including a matrix of luminescent dots with a plurality of such dots aligned with a front sight blade and a rear cylindrical sight including a windage luminescent strip member radially aligned with the rear sight for alignment with the front sight luminescent members. An accessory artificial light member enhances illumination of the luminescent members.

Applicant believes that another reference corresponds to U.S. Pat. No. 4,713,889 A issued to Julio A. Santiago on Dec. 22, 1987 for an illuminated gun sight. However, it differs from the present invention because Santiago teaches a gun sight that comprises an illuminated gunsight attachment for mounting on a weapon to permit a user to aim and shoot in low-light conditions. The illuminated gunsight includes a light-emitting diode for a front sight and an illuminated rod for a rear sight. Also includes a magnetic switch, which automatically activates a power circuit to illuminate the sights as a revolver is withdrawn from its holster. The illuminated gunsight attachment is mounted unobtrusively on the barrel of a weapon to permit use of either conventional sight posts of the weapon or the illuminated sights. The rear sight is formed by a set of parallel lines comprised of fluorescent markings located on opposite sides of an illuminated line. A firearm holster with a magnet activates the illuminated gunsight as it is withdrawn from the holster.

Applicant believes that another reference corresponds to U.S. Pat. No. 2,815,574 A issued to Du Varry Panayiotis Bacouros on Dec. 10, 1957 for a gun sight. However, it differs from the present invention because Bacouros teaches a gun sight comprising a front sight, a vertically adjustable rear sight aligned with the front sight, a relatively small triangular prism positioned on a firearm adjacent the rear sight and connected to the firearm for movement to a position projecting laterally from the firearm so as to be viewed simultaneously with the rear sight when aiming the firearm. The prism has a forward face, a bottom face, and a rear face, and being movably adjustable around an axis parallel to the edges of the prism. A line of luminescent is inscribed on a bottom face and is arranged so that light therefrom will be reflected internally from a forward face of the prims and will emerge through the rear face. The prism being formed and arranged to project a beam of light from the line of the luminescent material emerging from the rear face rearwardly in a direction to intersect with the line of sight passing through the front an rear sights at an aiming pit spaced rearwardly adjacent the rear sight.

Applicant believes that another reference corresponds to European Patent No. EP 2577213 B1 issued to John W. Matthews, et al. on Oct. 14, 2015 for a gun sight. However, it differs from the present invention because Matthews teaches a gun sights for firearms and related methods of use. The sight includes an apparatus mounted at a rear end of a firearm and arranged to occlude one eye of a user of the firearm and to generate an illuminated dot that is disposed such that it is generally centered on the longitudinal axis of a barrel of the firearm. The gun sight produces a collimated beam of light that creates an image of an illuminated dot by either a refractive method or a reflective method. In use, a dominant eye of the user is occluded by the sight and the other eye of the user is focused on the target. The user then adjusts the position of the gun relative to the target such that the user perceives the illuminated dot of the sight to be positioned on the target. In one embodiment the sight includes a dry fire detector that generates some output to the user, such as an increase in brightness of the illuminated dot, at the instant the weapon would have fired if a round had been in the chamber.

Other patents describing the closest subject matter provide for a number of more or less complicated features that fail to solve the problem in an efficient and economical way. None of these patents suggest the novel features of the present invention.

SUMMARY OF THE INVENTION

The instant invention is a sight assembly for firearms comprising rear and front sights.

More specifically, the present invention is a sight assembly for firearms, comprising a rear bottom sight, and a rear top sight comprising first and second top faces. Extending from the first and second top faces are first and second rear sight strips respectively. The present invention further comprises a front bottom sight, and a front top sight comprising a third top face. Extending from the third top face is a front sight strip.

In a preferred embodiment, the first and second rear sight strips are approximately perpendicular to the first and second top faces respectively and extend horizontally on the rear top sight. The first and second rear sight strips are white or bright colors, contrasting and can be fluorescent. The rear top sight mounts onto the rear bottom sight. Extending from the first and second rear sight strips are respective first and second sight strip bases that terminate at respective first and second sight strip base lips. The first and second sight strip bases extend approximately perpendicularly from the first and second rear sight strips.

The rear bottom sight comprises a mounting interface notch. The rear top sight comprises a mounting interface locking protrusion, and the mounting interface notch receives the mounting interface locking protrusion when the rear top sight mounts onto the rear bottom sight. The rear bottom sight comprises a rear face. The first and second rear sight strips are approximately flush with the rear face when the rear top sight mounts onto the rear bottom sight.

In a preferred embodiment, the front sight strip is approximately perpendicular to the third top face and extends horizontally on the front top sight. The front sight strip is white or bright colors, contrasting and can be fluorescent. The front top sight mounts onto the front bottom sight. Extending from the front sight strip is a sight strip base that terminates at a sight strip base lip. The sight strip base extends approximately perpendicularly from the front sight strip.

The front top sight comprises a concave section. The front bottom sight comprises a convex section, and the concave section receives the convex section when the front top sight mounts onto the front bottom sight. The front bottom sight comprises a face, and the front sight strip is approximately flush with the face when the front top sight mounts onto the front bottom sight.

It is therefore one of the main objects of the present invention to provide a sight assembly for firearms comprising rear and front sights.

It is another object of this invention to provide a sight assembly for firearms that produces a continuous sight strip when viewing a front sight strip through a notch defined by a rear top sight mounted onto a rear bottom sight when the front sight strip is aligned with first and second rear sight strips.

It is another object of this invention to provide a sight assembly for firearms that improves shooting accuracy.

It is another object of this invention to provide a sight assembly for firearms that improves elevation accuracy.

It is another object of this invention to provide a sight assembly for firearms that improves sighting speed or sight alignment speed.

It is another object of this invention to provide a sight assembly for firearms that can be used with all firearms, pistols, and rifles.

It is another object of this invention to provide a sight assembly for firearms, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
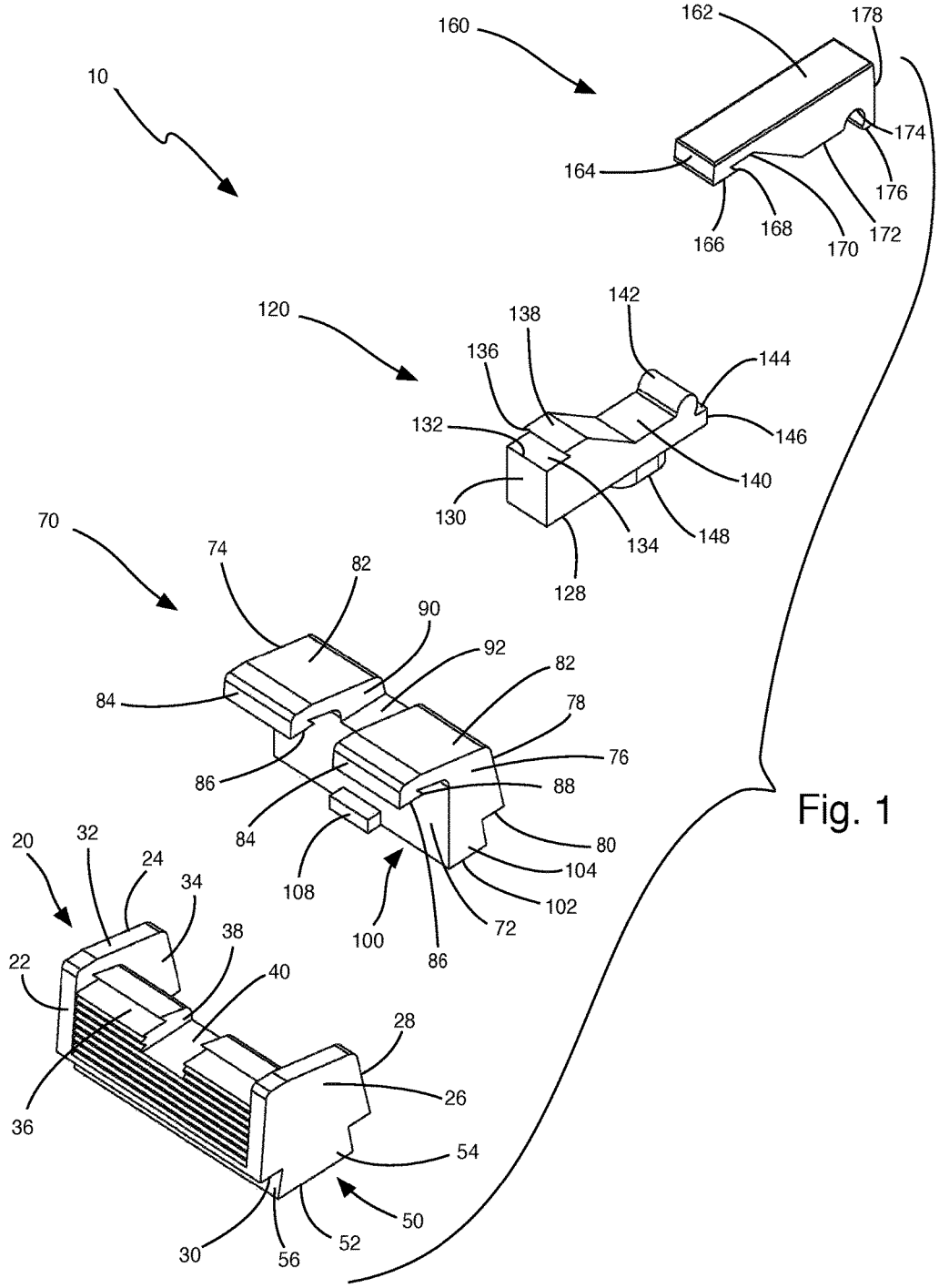
FIG. 1 represents an isometric top view of a sight assembly for firearms, object of the present invention.

Referring now to the drawings, the present invention is a sight assembly for firearms and is generally referred to with numeral 10.

As seen in FIG. 1, present invention 10 includes rear bottom sight 20, rear top sight 70, front bottom sight 120, and front top sight 160.

Figure 2:
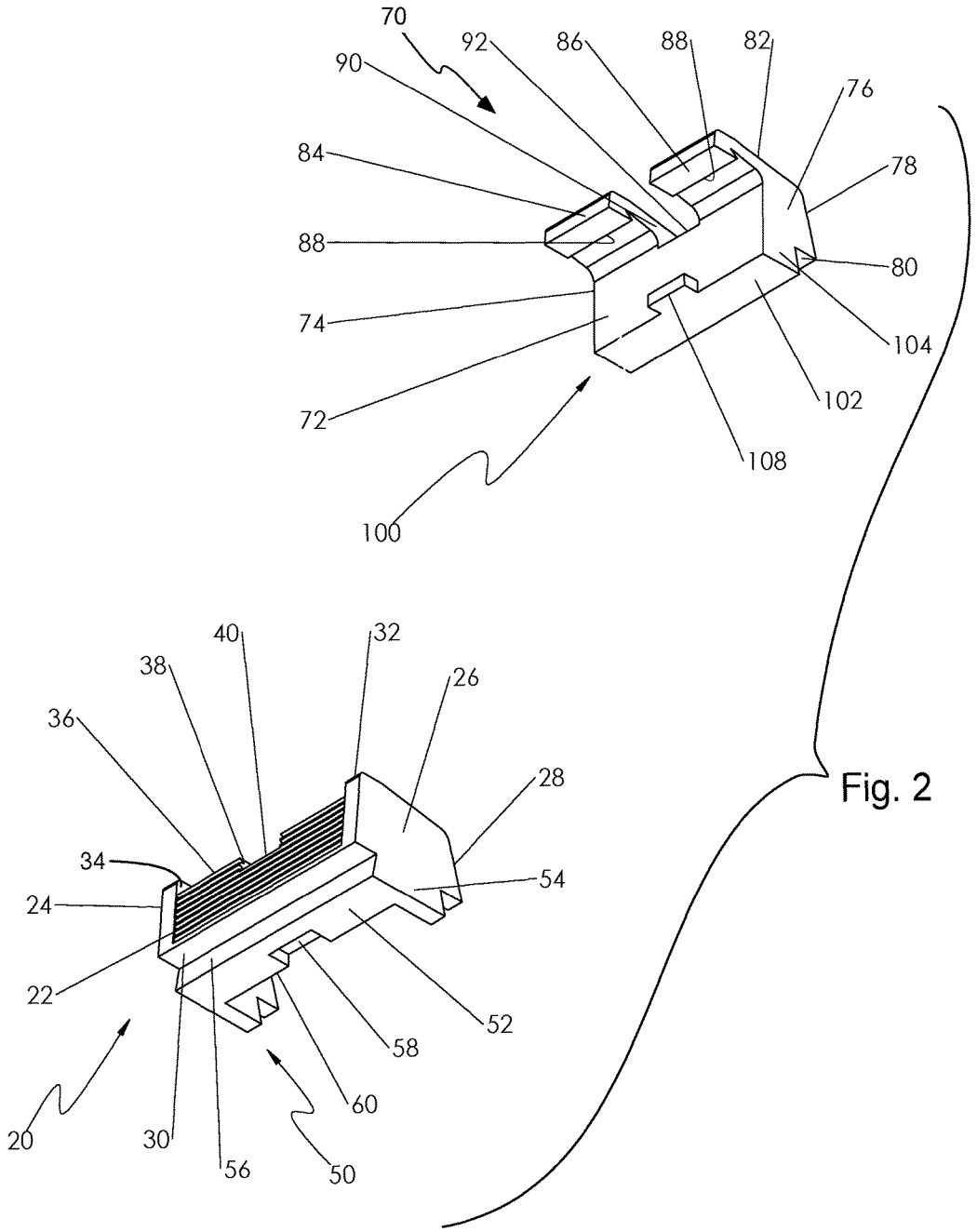
FIG. 2 is a first isometric bottom view of rear top and bottom sights.
Figure 3:
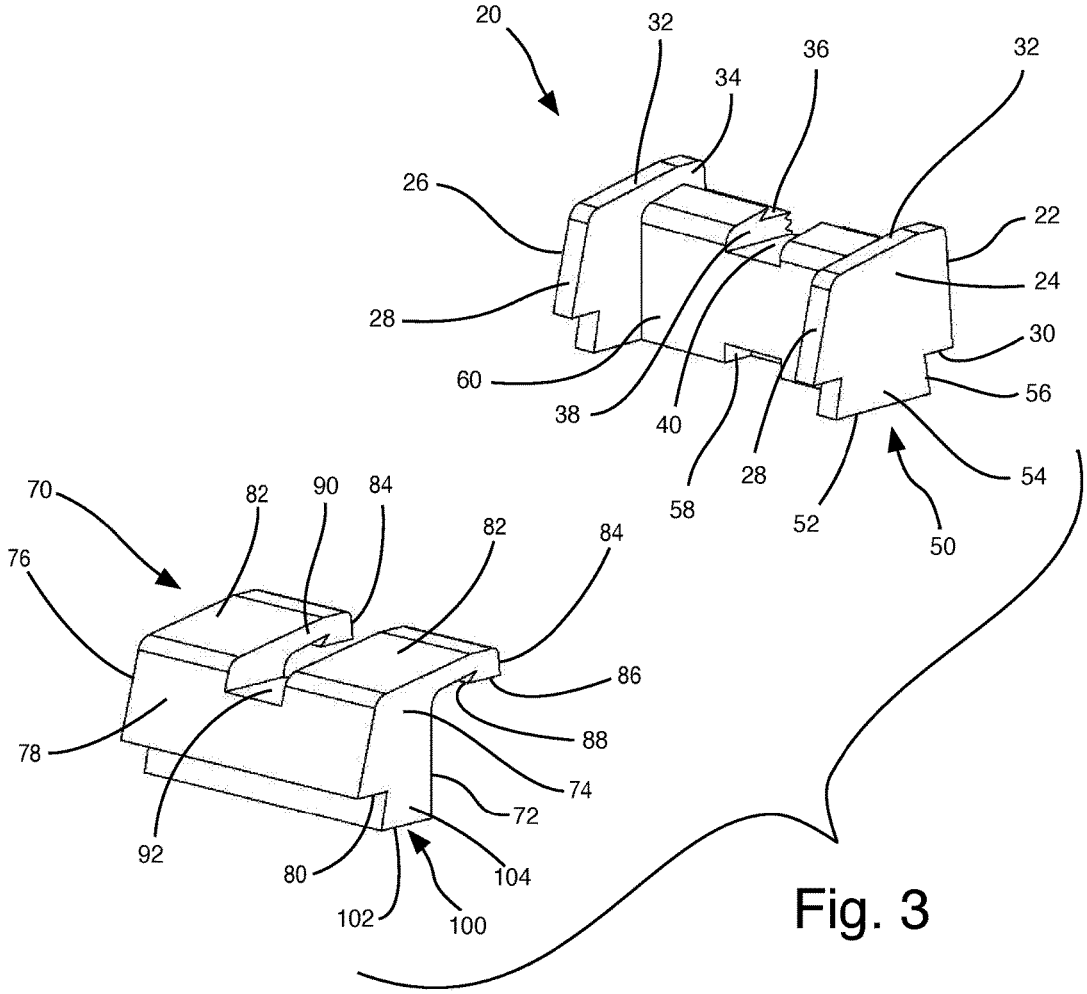
FIG. 3 is a second isometric bottom view of the rear top and bottom sights.

As seen in FIGS. 2 and 3, rear bottom sight 20 comprises rear face 22, lateral faces 24 and 26, front face 28, bottom face 30, and top faces 32.

First and second notch side faces 34 are defined on rear face 22 and top faces 32, and are at a first predetermined distance from lateral faces 24 and 26 respectively. In a preferred embodiment, first and second notch side faces 34 are approximately perpendicular to top faces 32 and the first predetermined distance from respective lateral faces 24 and 26 is the same. Extending from first and second notch side faces 34, towards each other, are first and second notch top faces 36. In a preferred embodiment, first and second notch top faces 36 are approximately perpendicular to their respective first and second notch side faces 34. In a preferred embodiment, rear face 22 is angled.

First and second channel side faces 38 are defined on rear face 22 and first and second notch top faces 36, and are at a second predetermined distance from lateral faces 24 and 26 respectively. In a preferred embodiment, first and second channel side faces 38 are approximately perpendicular to first and second notch top faces 36 and the second predetermined distance from respective lateral faces 24 and 26 is the same. Extending from first and second channel side faces 38 is channel face 40. In a preferred embodiment, channel face 40 is approximately perpendicular to first and second channel side faces 38.

Rear bottom sight 20 further comprises rear bottom mounting interface 50 comprising bottom mounting interface face 52 having lateral mounting interface faces 54, rear mounting interface face 56, and front mounting interface face 60. Mounting interface notch 58 is defined on bottom mounting interface face 52, and bottom mounting interface face 52 extends a third predetermined distance between lateral mounting interface faces 54. In a preferred embodiment, rear mounting interface face 56 is angled.

Rear top sight 70 comprises rear face 72, lateral faces 74 and 76, front face 78, bottom face 80, and first and second top faces 82. Extending from first and second top faces 82 are first and second rear sight strips 84. In a preferred embodiment, first and second rear sight strips 84 are approximately perpendicular to the first and second top faces 82 respectively and extend horizontally on rear top sight 70. In a preferred embodiment, first and second rear sight strips 84 are white or bright colors, contrasting and can be fluorescent. Rear top sight 70 mounts onto rear bottom sight 20. Extending from first and second rear sight strips 84 are respective first and second sight strip bases 86 that terminate at respective first and second sight strip base lips 88. First and second sight strip bases 86 extend approximately perpendicularly from first and second rear sight strips 84. Extending from lateral faces 74 and 76 are first and second top faces 82 that terminate at channel side faces 90. Rear top sight 70 further comprises channel face 92 positioned in between channel side faces 90 to define a "U" shape.

Rear top sight 70 comprises rear top mounting interface 100 having mounting interface base 102, and lateral mounting interface faces 104. Rear top sight 70 further comprises mounting interface locking protrusion 108. Mounting interface notch 58 receives mounting interface locking protrusion 108 when rear top sight 70 mounts onto rear bottom sight 20.

Figure 4:
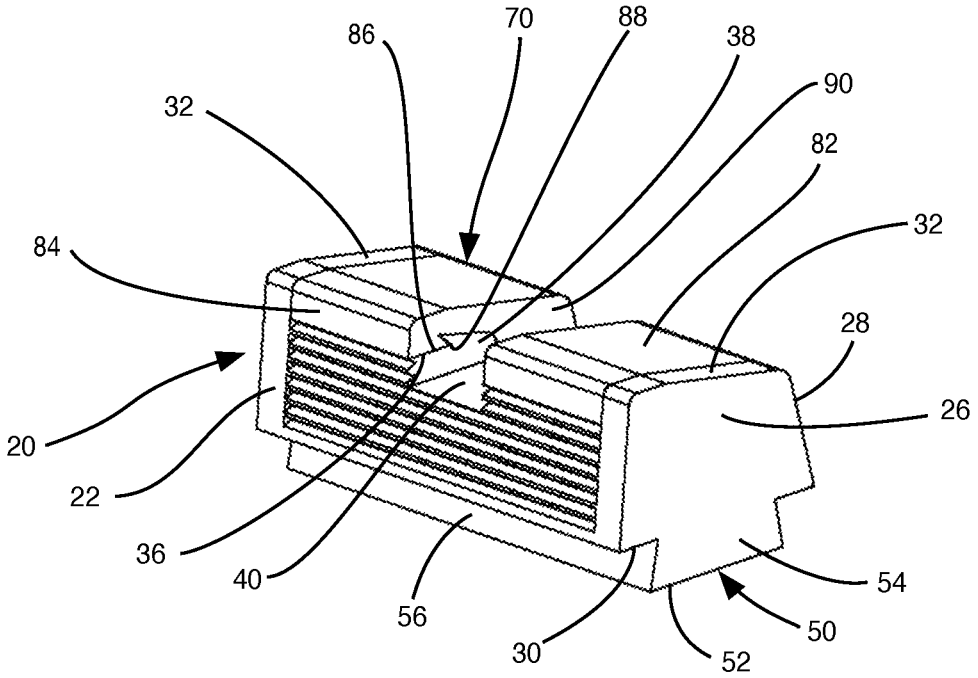
FIG. 4 is an isometric view of the rear top and bottom sights assembled.

As seen in FIG. 4, first and second rear sight strips 84 are approximately flush with rear face 22 when rear top sight 70 mounts onto rear bottom sight 20.

Figure 5:
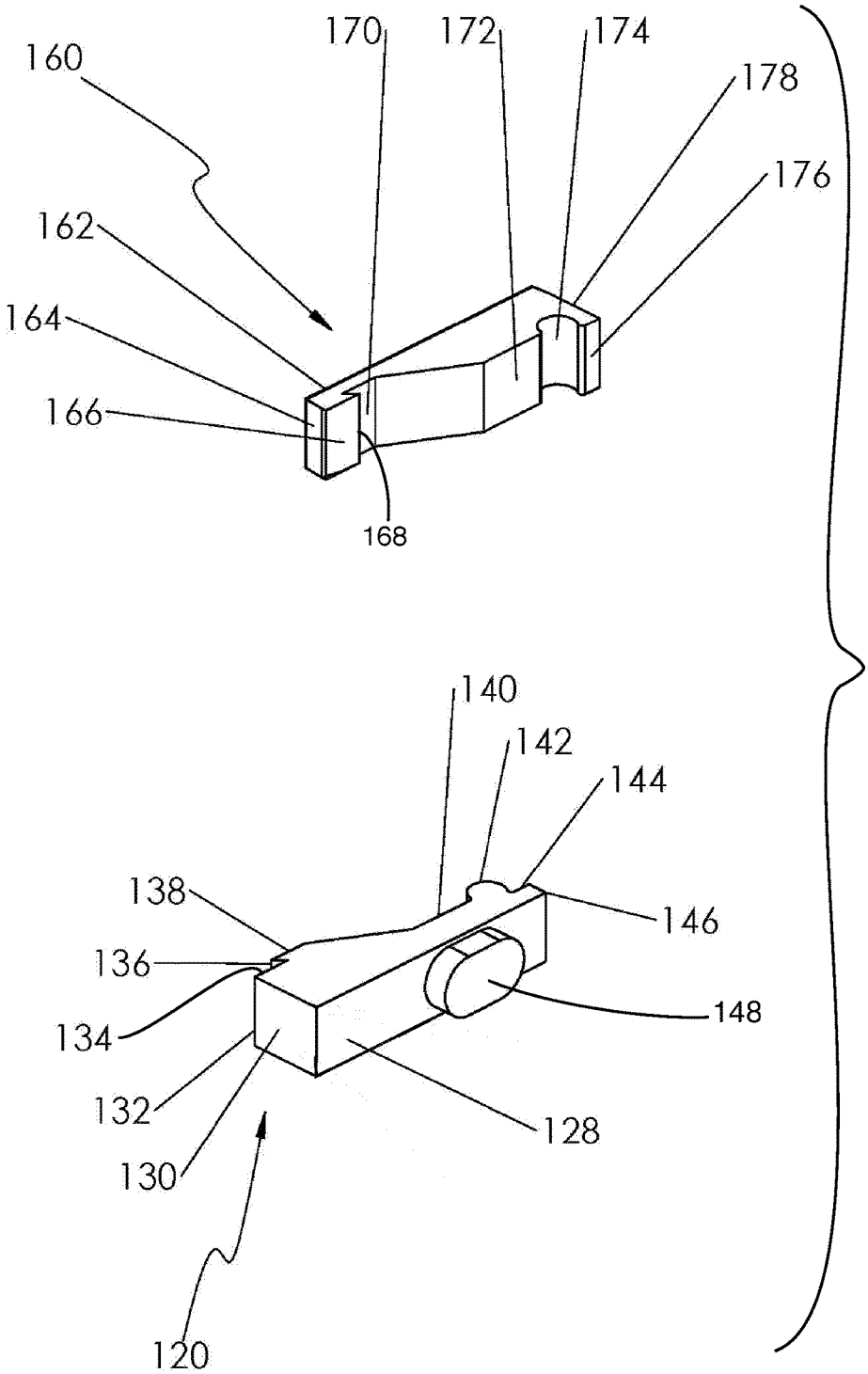
FIG. 5 is an isometric bottom view of front top and bottom sights.
Figure 6:
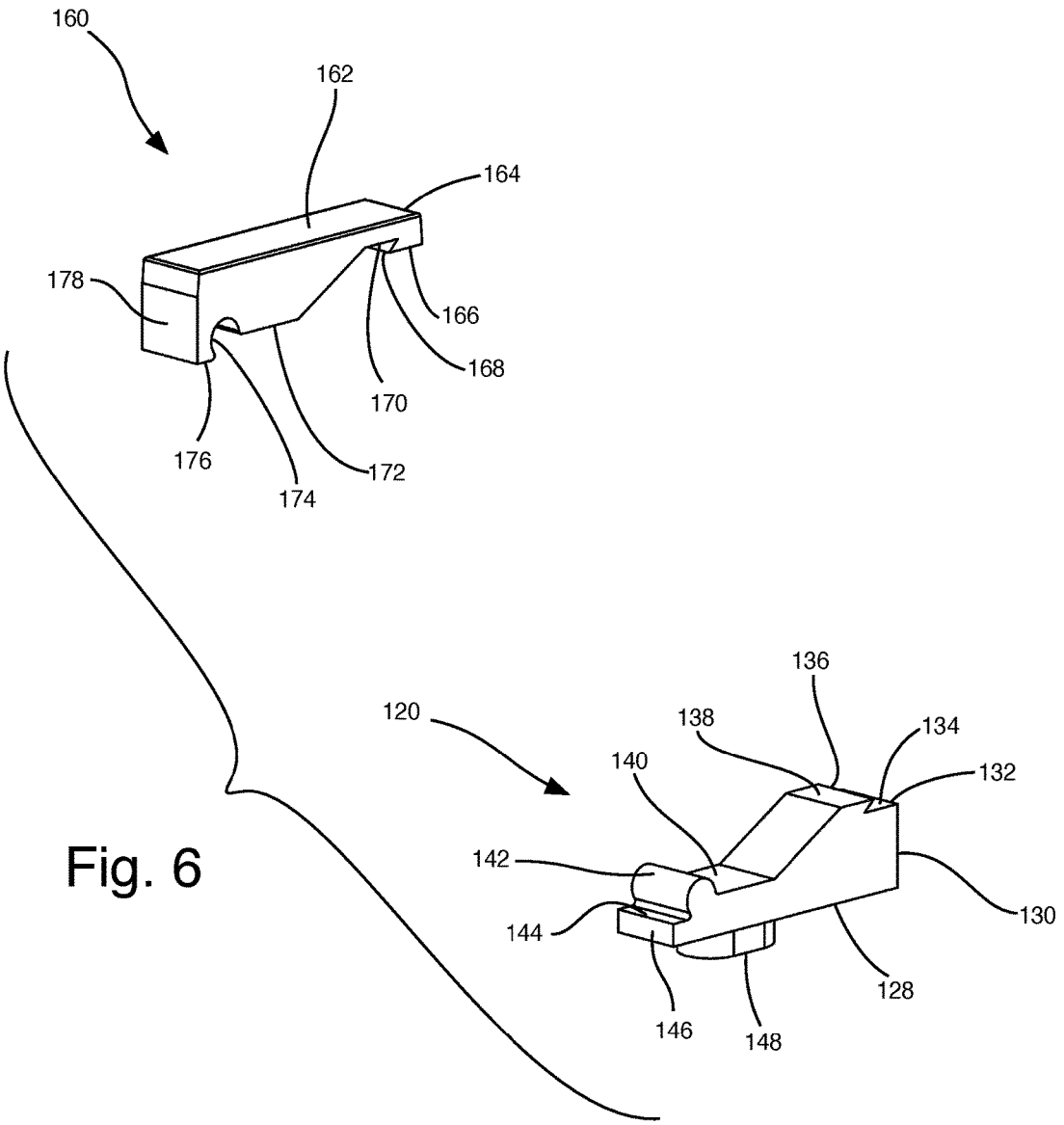
FIG. 6 is an isometric top view of the front top and bottom sights.

As seen in FIGS. 5 and 6, front bottom sight 120 comprises front base bottom 128. Protruding from base bottom 128 is post 148. Front bottom sight 120 further comprises face 130 that extends to top end 132. Extending from top end 132 is notch 134 that extends to locking lip 136. Extending from locking lip 136 is top 138 that extends to valley 140. Valley 140 extends to convex section 142. Convex section 142 extends to top face 144 having end 146.

Front top sight 160 comprises top face 162. Extending from top face 162 is front sight strip 164. In a preferred embodiment, front sight strip 164 is approximately perpendicular to top face 162 and extends horizontally on front top sight 160. In a preferred embodiment, front sight strip 164 is white or bright colors, contrasting and can be fluorescent. Front top sight 160 mounts onto front bottom sight 120. Extending from front sight strip 164 is sight strip base 166 that terminates at sight strip base lip 168. Sight strip base 166 extends approximately perpendicularly from front sight strip 164.

Front top sight 160 further comprises interior face 170 that extends from sight strip base lip 168 to interior hill 172. Interior hill 172 extends to concave section 174. Concave section 174 extends to interior base 176 having end 178. Concave section 174 receives convex section 142 when front top sight 160 mounts onto front bottom sight 120. Front sight strip 164 is approximately flush with face 130 when front top sight 160 mounts onto front bottom sight 120.

Figure 7:
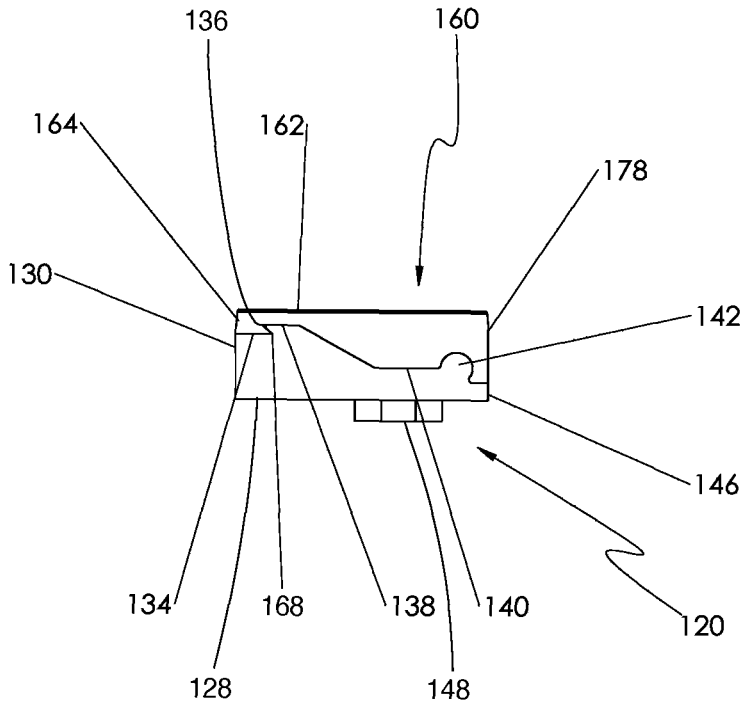
FIG. 7 is a side elevation view of the front top and bottom sights assembled.

As seen in FIG. 7, front sight strip 164 is approximately flush with face 130 when front top sight 160 mounts onto front bottom sight 120.

Figure 8:
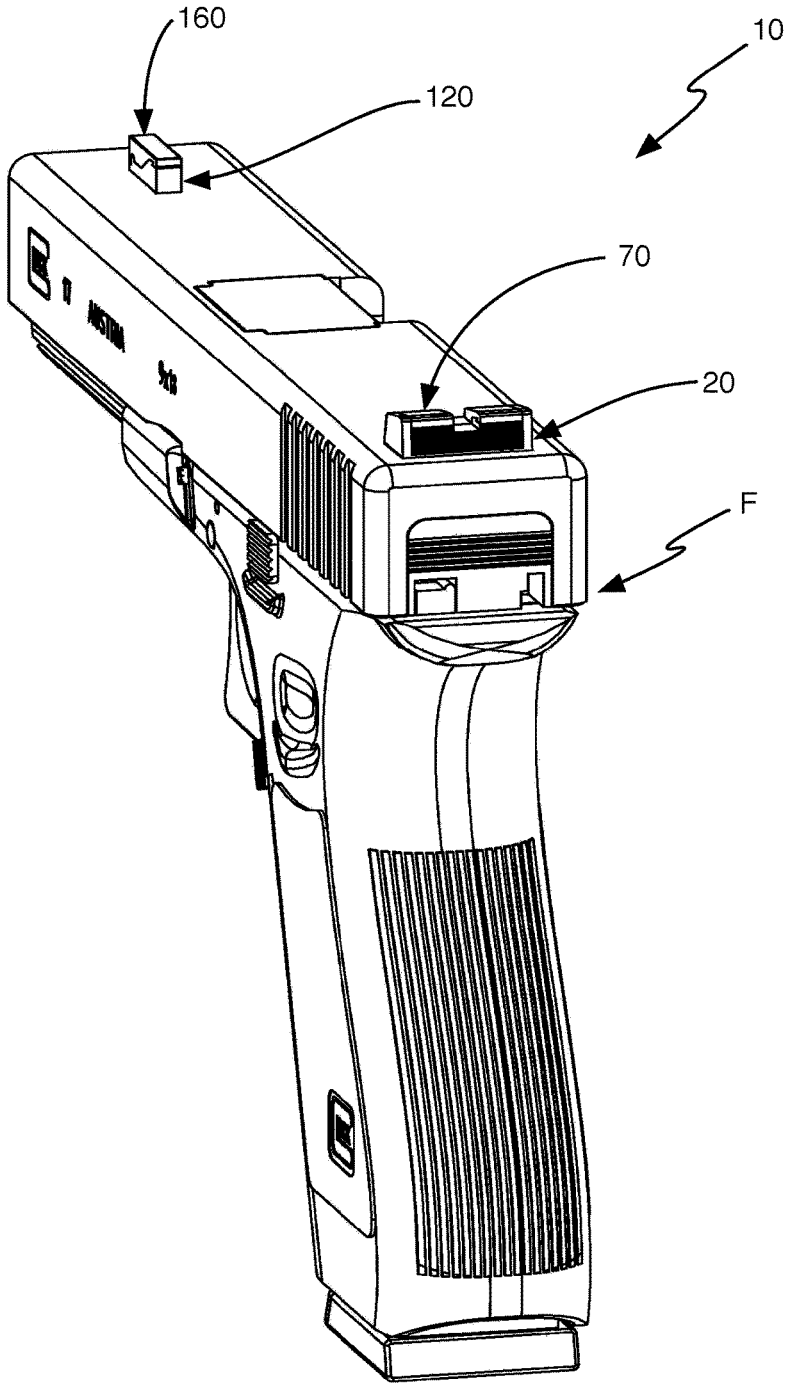
FIG. 8 is an isometric view of the sight assembly for firearms mounted onto a firearm.
Figure 9:
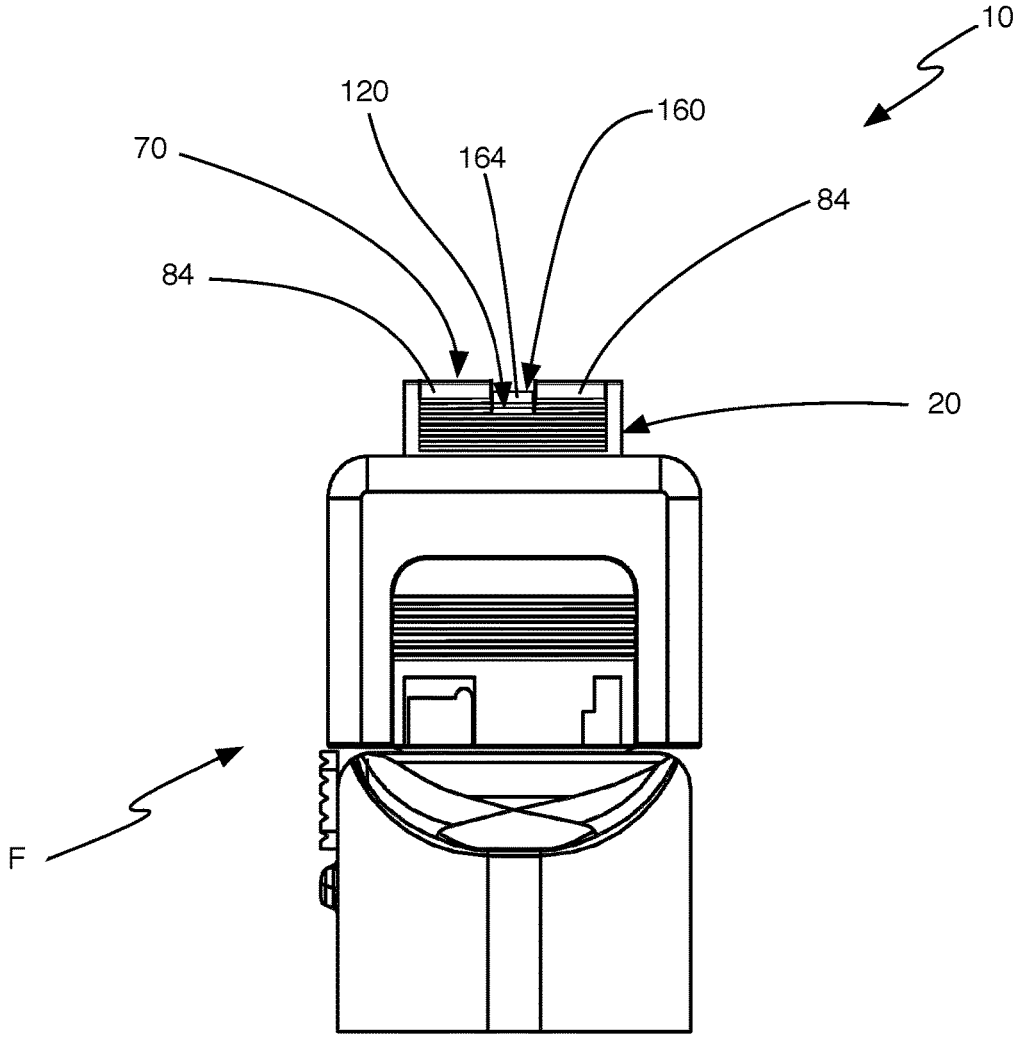
FIG. 9 is a rear elevation view of the sight assembly for firearms mounted onto the firearm.

As seen in FIGS. 8 and 9, present invention 10 is installed onto firearm F. Although not illustrated, it is understood that front top sight 160 and front bottom sight 120 comprise a means to attach to firearm F. Such a means to attach to firearm F may be as an example at least one screw extending through front top sight 160 and front bottom sight 120 to firearm F.

Present invention 10 therefore produces a continuous sight strip when viewing front sight strip 164 through a notch defined by rear top sight 70 mounted onto rear bottom sight 20 when front sight strip 164 is aligned with first and second rear sight strips 84, resulting in improved shooting accuracy, elevation accuracy, and sighting speed or sight alignment speed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sight assembly for firearms, comprising:

A) a rear bottom sight;

B) a rear top sight comprising first and second top faces, extending from said first and second top faces are first and second rear sight strips respectively;

C) a front bottom sight comprising a convex section; and

D) a front top sight comprising a third top face, extending from said third top face is a front sight strip to produce a visually continuous sight strip when viewing said front sight strip through a notch defined by said rear top sight mounted onto said rear bottom sight when said front sight strip is aligned with said first and second rear sight strips, said front top sight further comprising a concave section, said concave section receives said convex section when said front top sight mounts onto said front bottom sight.

2. The sight assembly for firearms set forth in claim 1, further characterized in that said first and second rear sight strips are approximately perpendicular to respective said first and second top faces.

3. The sight assembly for firearms set forth in claim 1, further characterized in that said first and second rear sight strips extend horizontally on said rear top sight.

4. The sight assembly for firearms set forth in claim 1, further characterized in that said first and second rear sight strips are white or bright colors, and fluorescent.

5. The sight assembly for firearms set forth in claim 1, further characterized in that said rear top sight mounts onto said rear bottom sight.

6. The sight assembly for firearms set forth in claim 1, further characterized in that extending from said first and second rear sight strips are respective first and second sight strip bases that terminate at respective first and second sight strip base lips.

7. The sight assembly for firearms set forth in claim 6, further characterized in that said first and second sight strip bases extend approximately perpendicularly from said first and second rear sight strips.

8. The sight assembly for firearms set forth in claim 1, further characterized in that said front sight strip is approximately perpendicular to said third top face.

9. The sight assembly for firearms set forth in claim 1, further characterized in that said front sight strip extends horizontally on said front top sight.

10. The sight assembly for firearms set forth in claim 1, further characterized in that said front sight strip is white or bright colors, and fluorescent.

11. The sight assembly for firearms set forth in claim 1, further characterized in that said front top sight mounts onto said front bottom sight.

12. The sight assembly for firearms set forth in claim 1, further characterized in that extending from said front sight strip is a sight strip base that terminates at a sight strip base lip.

13. The sight assembly for firearms set forth in claim 12, further characterized in that said sight strip base extends approximately perpendicularly from said front sight strip.

14. The sight assembly for firearms set forth in claim 1, further characterized in that said rear bottom sight comprises a mounting interface notch.

15. The sight assembly for firearms set forth in claim 14, further characterized in that said rear top sight comprises a mounting interface locking protrusion, and said mounting interface notch receives said mounting interface locking protrusion when said rear top sight mounts onto said rear bottom sight.

16. The sight assembly for firearms set forth in claim 1, further characterized in that said rear bottom sight comprises a rear face, first and second lateral faces, a front face, a bottom face, fourth and fifth top faces, and first and second notch side faces that are defined on said rear face and said fourth and fifth top faces, whereby said first and second notch side faces are at a predetermined distance from said first and second lateral faces respectively.

17. The sight assembly for firearms set forth in claim 16, further characterized in that said first and second rear sight strips are approximately flush with said rear face when said rear top sight mounts onto said rear bottom sight.

18. The sight assembly for firearms set forth in claim 1, further characterized in that said front bottom sight comprises a face, and said front sight strip is approximately flush with said face when said front top sight mounts onto said front bottom sight, said front bottom sight further comprises a front base bottom, protruding from said front base bottom is a post, said face extends to a top end.

* * * * *